US006941852B1

(12) United States Patent
Le et al.

(10) Patent No.: US 6,941,852 B1
(45) Date of Patent: Sep. 13, 2005

(54) UNITARY HOLLOWED PISTON WITH IMPROVED STRUCTURAL STRENGTH

(75) Inventors: Anh Le, Lockport, NY (US); Roy Allan Plew, Tonawanda, NY (US); John F. Quesada, Williamsville, NY (US)

(73) Assignee: Delphi Technologies, Inc., Troy, MI (US)

( * ) Notice: Subject to any disclaimer, the term of this patent is extended or adjusted under 35 U.S.C. 154(b) by 3 days.

(21) Appl. No.: 10/787,287

(22) Filed: Feb. 26, 2004

(51) Int. Cl.[7] ..... F04B 27/08
(52) U.S. Cl. ..... 92/71; 92/175
(58) Field of Search ..... 92/12.2, 71, 175; 417/269

(56) References Cited

U.S. PATENT DOCUMENTS

| | | | | |
|---|---|---|---|---|
| 5,630,353 | A | 5/1997 | Mittlefehldt et al. | 92/71 |
| 5,765,464 | A | 6/1998 | Morita | 92/71 |
| 5,899,135 | A | 5/1999 | Kanou et al. | 92/71 |
| 5,941,161 | A * | 8/1999 | Kimura et al. | 92/175 |
| 5,953,980 | A | 9/1999 | Ota et al. | 92/71 |
| 6,024,009 | A | 2/2000 | Morita | 92/12.2 |
| 6,216,584 | B1 | 4/2001 | Terauchi | 92/160 |
| 6,324,960 | B1 | 12/2001 | Enokijima et al. | 92/71 |
| 6,339,984 | B1 | 1/2002 | Sugioka et al. | 92/248 |
| 6,484,621 | B1 | 11/2002 | Kato et al. | 92/71 |

FOREIGN PATENT DOCUMENTS

| | | |
|---|---|---|
| JP | H7-189900 | 7/1995 |
| JP | 2924621 | 5/1999 |

* cited by examiner

*Primary Examiner*—Thomas E. Lazo
(74) *Attorney, Agent, or Firm*—Patrick M. Griffin

(57) ABSTRACT

A unitary, "hollow out" piston is molded or forged with only two tools, which move along a single parting direction, with a pair of arcuate side walls that provide maximal outer surface area with minimal thickness and weight. The thin walls are internally fortified by a cruciform support structure that is molded integrally by the same tools. No post forming machining steps are needed to reduce weight.

3 Claims, 4 Drawing Sheets

UNITARY HOLLOWED PISTON WITH IMPROVED STRUCTURAL STRENGTH

TECHNICAL FIELD

This invention relates to compressor pistons in general, and specifically to a one piece piston, capable of forging or molding (including casting), which maximizes surface area and strength while minimizing mass within the limitations of the method of manufacture.

BACKGROUND OF THE INVENTION

Compressor pistons historically were solid metal cylinders, structurally sound and with more than sufficient outer surface area, but inherently massive. Mass could be reduced only by axially shortening the piston, inevitably reducing the outer surface area. Since compressor pistons are typically driven by an inclined swash plate, the reciprocating forces applied to the pistons inevitably have non axial components that act to rock the piston about its axis within the cylinder bore. The outer surface area of the piston is needed to resist these rocking forces, so its outer surface area, ideally, would not be reduced too far from a complete cylinder.

The obvious first approach to maintaining piston outer surface area while reducing mass is to completely hollow out the piston body itself. Just as obviously, this cannot be done in a one piece design. That is, the lower end of a bottle can be integrally formed, but its lid cannot. Thus, myriad designs have been suggested in the prior art where the end cap of the piston, the lid of the bottle, in effect, are attached by numerous techniques. While these are undeniably low mass, with complete outer surface areas, a multi piece design, requiring an extra manufacturing step to join the multiple pieces, is inevitably higher cost than a one piece or unitary design.

The next iterations in the continuing quest to produce compressor pistons that were not solid and massive, but still unitary, were various "hollowed out" designs. That is, internal mass was removed, reducing mass and weight, but outer surface area was inherently removed as well by the process of "hollowing", whether that process was forging, molding, or machining. These "hollowed out" designs produced many ultimate shapes, most of which were impractical and did not see ultimate production.

An early design in this area is seen in Japanese Patent 2924621, first published in 1995 as Laid Open Application 7-189900. Two ways of hollowing out the piston were proposed there. One hollowed out both sides of the piston up to, and stopping at, a solid web of material at the central plane of the piston. This created an I beam shape, in cross section, leaving outer surface area only at the top and bottom of the piston outer envelope, but none on the sides. The other embodiment hollowed one entire side, leaving a thin walled, C shaped shell on the other side, but with essentially no outer surface area left on the hollowed out side. Both designs had the advantage of being moldable or forgable, that is, formable by only two tools or dies that approach and part along a straight line. None of the internal surfaces, as seen in cross section, present any concavities or "under cuts" relative to the line of tool parting, which can be considered either a result of, or an enabler to, the manufacturing method. Neither design was particularly practical, since one removed too much sides surface area, and the other, while it left a good deal of surface area at least on the critical piston side, left no internal support for the thin, C shaped shell.

A design that followed soon after, disclosed in co assigned U.S. Pat. No. 5,630,353, incorporated herein by reference, was also a hollowed out shape, but with no central web, being hollow through and through, as viewed from the side. A reference frame for the outer surface of the piston was designated in FIG. 8 of the patent, arbitrary but convenient, which divided up the potential outer surface area or envelope of the piston into four basic quadrants or sections, with a central plane P arrayed on the 12 o'clock-six o'clock line. In that context, a radially inwardly facing quadrant I is centered at the 12 o'clock point, an opposed radially outwardly facing quadrant O defined is centered at the 6 o'clock point, and two opposed side quadrants S are centered at the 3 and 9 o'clock points respectively, each subtending 90 degrees of the total 360 degrees. Shorter cylinders F and B at the front and back of the envelope represent, in effect, the top and bottom of the bottle, while the other quadrants divide up the outer surface of the bottle. This reference frame for the piston is defined, most generally, relative only to an arbitrary central plane P of the piston itself. In terms just of how the piston shape is described, it is not necessary that the piston reference frame correspond to the reference frame of the cylinder block/compressor, that is, it isn't necessary that the central plane P of each piston also, if extended, contain the axis of the cylinder block/shaft. The terms "radially facing", whether inwardly or outwardly, have to be understood, then, in the context of the reference frame of just the piston's center axis itself, considered alone. That is, the radial inward and outward directions might or might not correspond to the same directions relative to the cylinder block/shaft axis. It is convenient for ease of manufacturing the piston as a whole, however, that the central planes P of each piston do intersect the block/shaft axis, so that so that the radial directions "in" and "out" would match, and that is the convention used here.

This arbitrary reference frame, recreated here in FIG. 8 as well, conveniently demonstrates the various features and shortcomings of the myriad designs proposed in the published patent literature. For example, the first, "I beam" embodiment of Japanese Patent 2924621 has surface area on both quadrants I and O, but essentially no surface area on the side quadrants S, with a heavy web at the central plane P. The second, C shaped embodiment has surface area arrayed over I, O and one side quadrant S, but essentially none on the other side quadrant S, and with no central support for the thin walled shell. The design in U.S. Pat. No. 5,630,353 improved on both of these embodiments with a shape that provided surface area on I and O, no heavy web on the central plane P, but with special "sled runner" features 40 that put some surface area, at least, on both side quadrants S. The shape disclosed there was still moldable or formable by only two tool elements. However, a drawback of both this design and the first embodiment of Japanese Patent 2924621 is that the wall thickness radially inboard of the piston outer surface area is greater than is ideal. That is, as seen in a cross section normal to the piston length axis A (FIG. 7 of U.S. Pat. No. 5,630,353, for example), the wall section is lunate in shape, that is, it has a cross sectional area essentially bounded by the arc and chord of a circle, far thicker and heavier that a section consisting of two closely spaced and concentric arcs. But, the flat, chordal side of the wall section is what is inevitably left behind by the advancing and retreating forging die or casting mold. On the other hand, the C shaped cross section of the second embodiment of Japanese Patent 2924621 is far thinner, consisting basically of two closely spaced concentric arcs, but, as noted, it has almost no surface area on one side quadrant S, and almost no central internal support to the thin wall.

A plethora of patented designs subsequent to these two early disclosures have dealt with these various design constraints with varying degrees of success. U.S. Pat. No. 5,765,464 catalogs the various prior art hollow, or hollowed out, piston designs at that point, noting that one prior design in particular, shown in FIG. 3*a*, hollowed out the piston with two intersecting cavities, each of which primarily removed surface area from the I and O surface quadrants (as discussed relative to the instant FIG. 8 above). This was described as removing too much outer surface area, but did at least have the advantage of being a unitary, one piece design. The improvement touted by the patent itself, while having more outer surface area, is not a one piece design, needing a separate cap to close of the F end section shown in FIG. 8. A multi piece design is far less desirable than a one piece design.

A more recent patent, U.S. Pat. No. 6,324,960, discloses a variant of the I beam embodiment shown in Japanese patent 2924621 discussed above. As best seen in its FIG. 11A, the lunate, overly thick wall section has been machined out at 224 and 226, thinned out to more closely match the ideally thin, concentric arcs shape. However, this is achieved only at the cost of an additional machining step, done after the molding or forging process.

In conclusion, the piston art to date has failed to achieve an ideal combination of one piece, substantially hollow construction with a well distributed outer surface area that is internally well supported, but with minimal wall thickness behind the outer surface area, and which is also formed with a minimum of manufacturing steps.

SUMMARY OF THE INVENTION

The subject invention provides a piston design that substantially meets the ideal guidelines outlined above.

In the preferred embodiment disclosed, the main body of the piston can be formed by two dies or molds that part in a straight parting line, creating two main outer surface areas, each of which is generally a C shaped, arcuate cross section wall, and minimally thick, and approximately the same length. The C shaped walls each extend over slightly more than 180 degrees, on each side of the piston, providing adequate and well balanced bearing surface within the cylinder. The C shaped walls also overlap in narrow strips of lunate in cross section at the top and bottom, which provides some mutual support between the two walls. The majority of the internal support for the C shaped walls is provided by an intermediate support disk, located about half way axially between, and parallel to, the piston head and foot, and a pair of axially extending webs 44 formed integrally with, and central to, the inner surface of each wall C shaped wall. The webs extend axially between each side of the central disk and the piston foot and head, respectively. He central disk and integral webs together provide a symmetrical, cruciform internal support frame for the C shaped bearing walls, and are capable of being manufactured by the same molds or forge dies that form the C shaped walls.

DESCRIPTION OF THE PREFERRED EMBODIMENT

Figure 1:
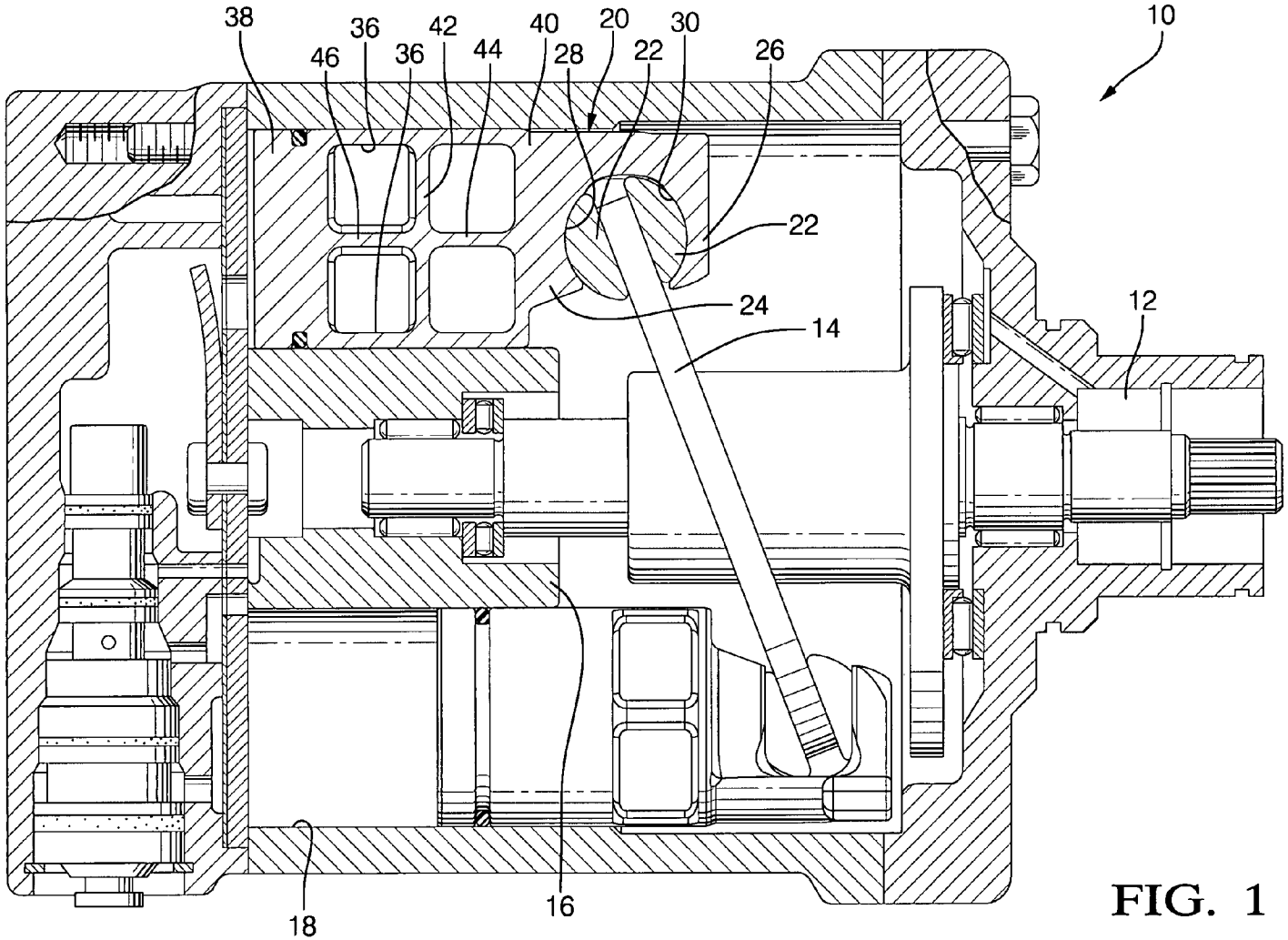
FIG. 1 is a cross section of a compressor housing, showing one piston in cross section, and one in elevation.
Figure 2:
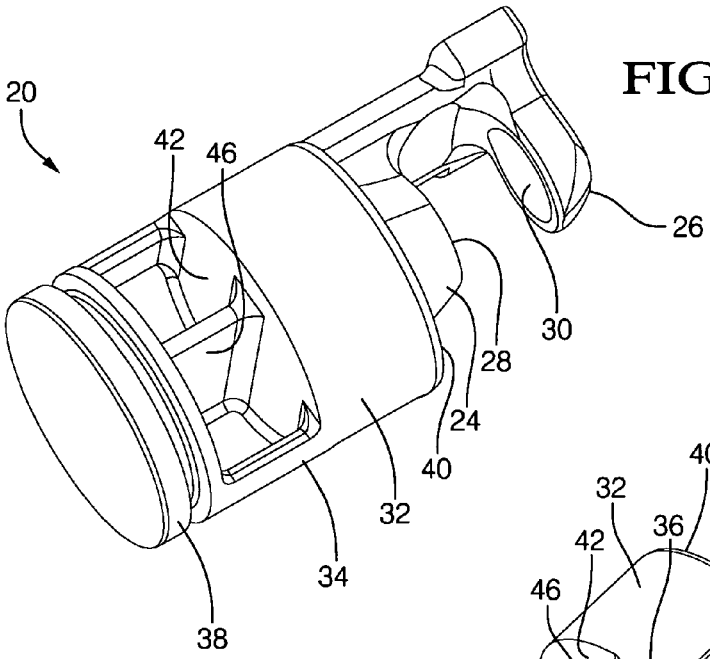
FIG. 2 is a perspective view of a piston showing one side quadrant.
Figure 3:
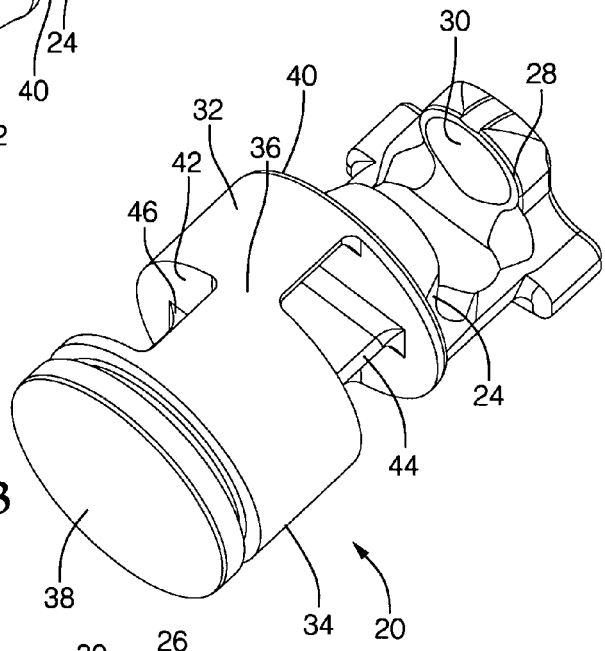
FIG. 3 is a perspective view of a piston showing the I quadrant, as defined in FIG. 8.
Figure 4:
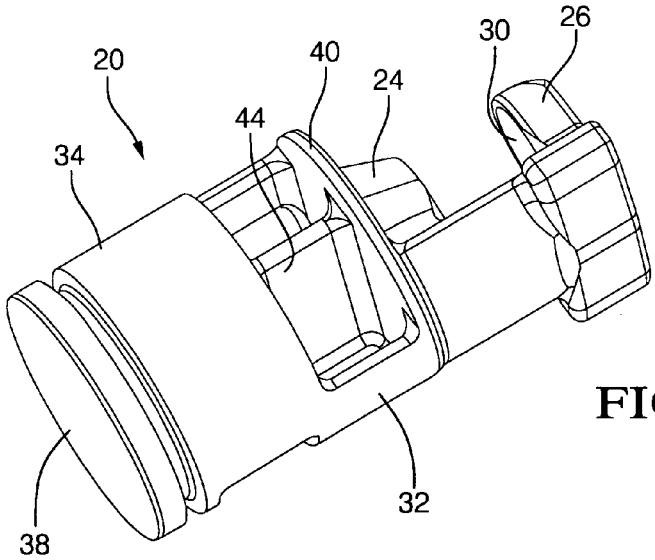
FIG. 4 is a perspective view showing the other side quadrant.

Referring first to FIG. 1, a compressor 10 has a central driven shaft 12, which rotates a nutating swash or wobble plate 14 within a cast cylinder block 16. Defined within cylinder block 16 are an array of cylinder bores 18, generally 5 to 7 in number. If, for convenience, the piston reference frame described above is oriented with each central plane P including the axis of shaft 12, the in surface of the bore 18 may be considered to have its surface area divided up into corresponding quadrants. A piston, designated generally at 20, is reciprocated axially within each bore 18 by a pair of half ball shoes 22, as the plate 14 slides between the flat sides of the shoes 22. At the rear of each piston 20, a pair of parallel stanchions 24 and 26 contain machined ball sockets 28 and 30, within which the spherical sides of the shoes 22 twist as the plate 14 nutates back and forth on shaft 12. The stanchions 24, 26 and sockets 28, 30 are a standard feature of swash plate driven pistons. The remainder or body of the piston 20 may be formed in different ways, details of which are described below.

Figure 8:
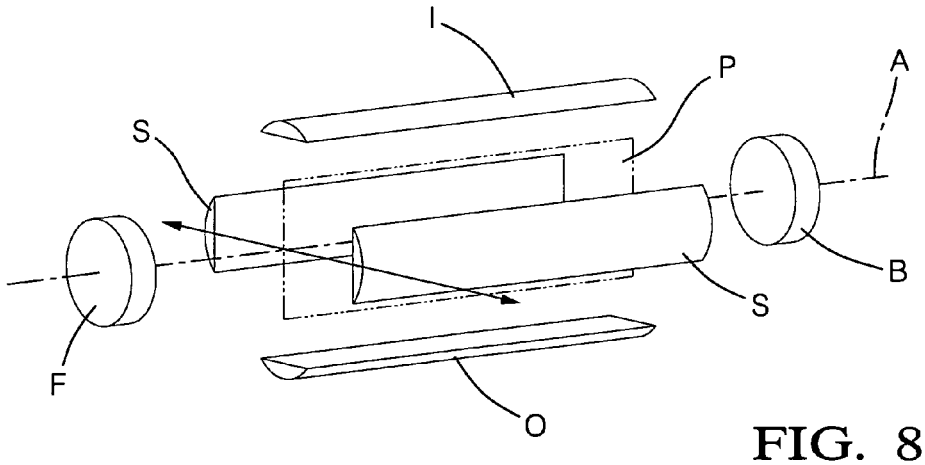
FIG. 8 is a schematic perspective view of a general piston shape divided up into quadrants and other sections, for easy reference.

Before turning to particular details of the shape and structure of piston 20, it is useful to review the reference frame defined in FIG. 8, already discussed above, as well as some of the design guidelines and limitations. While a piston cannot one piece, hollowed out, and still have a complete cylindrical outer surface all at once, it is desirable to have at least some outer surface area, which is the bearing surface area that will rub on the inner surface of bore 18, provided on all of the possible quadrants I, O and S. It is also desirable to have the outer surface area arrayed fairly symmetrically, although it may well be desirable to provide more surface on one side S than another, to account for the fact that the swash plate 14 will drive one side S more strongly into the surface of bore 18 than the other. While it is desirable that all of the walls that carry the outer surface area be truly arcuate and thin, rather than lunate in cross section, they should still have adequate internal support. The subject design meets all of these guidelines.

Referring next to FIGS. 3 through 7, a preferred embodiment of the piston 20 of the subject invention has a main body (that part of piston located forward of the stanchions 24 and 26) that is comprised of two generally C shaped, arcuate walls 32 and 34, each of which has a generally C shaped, arcuate cross section, with minimal thickness. By "arcuate" it is meant that the walls 32 and 34 have a minimal thickness, that is, in cross section, they comprise inner and outer surfaces that are, for the most part, two concentric arcs, rather than the lunate shape frequently found in prior designs. The two C shaped walls 32 and 34 extend circumferentially over at least 180 degrees, up to the central plane P as described in FIG. 8, and therefore each wall 32 and 34 provides bearing surface area on all of a side surface portion S and about half of the other two side surface portions I and O. That surface area is not provided over the entire axial length of piston 20, of course, but where wall 32 "isn't," wall 34 "is," in effect, and vice versa. In the embodiment disclosed, each side wall 32 and 34 subtends more than 180 degrees, extending past the central plane P, and, as a consequence, two diametrically opposed narrow strips are created, one of which is indicated by the dotted lines at 36 in FIG. 3, which represent shared area between the two walls 32 and 34, centrally located in the quadrants I and O as defined in FIG. 8. As seen best in FIG. 5, each strip 36 inevitably will take on the lunate shaped defined above, and comprises the only part of the walls 32 and 34 that is not totally arcuate and minimally thick as defined above. This narrow strip of thickened cross section is an inevitable by product of forming the walls 32 and 34 to extend over more than 180 degrees, and forming them in one step with only two tools, such as molds or forging dies, that approach and part along a straight line, as shown by the arrows labeled A and B in FIG. 7. More about the manufacturing method is described below, in relation to the internal support structure. While thicker than the walls 32 and 34, the strips 36 created by the deliberate overlap are beneficial in that they knit the two walls 32 and 34 together, and provide more outer bearing area, than would be the case if each wall 32 and 34 subtended exactly 180 degrees only.

Figure 5:
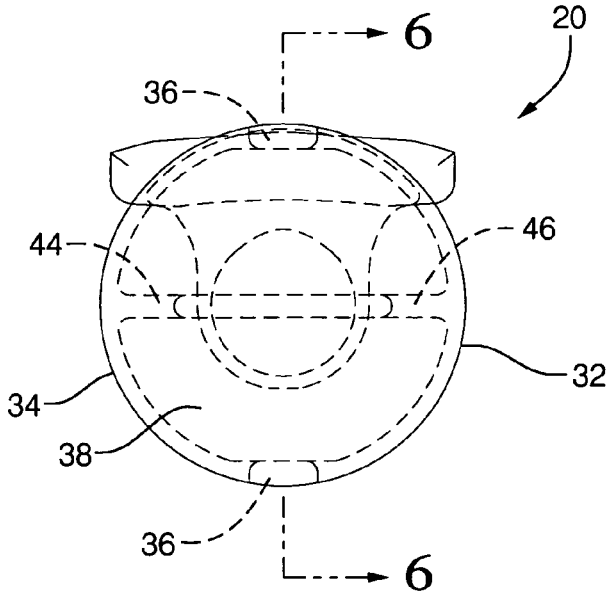
FIG. 5 is a front end axial view of a piston, showing internal supporting structure in dotted lines.
Figure 6:
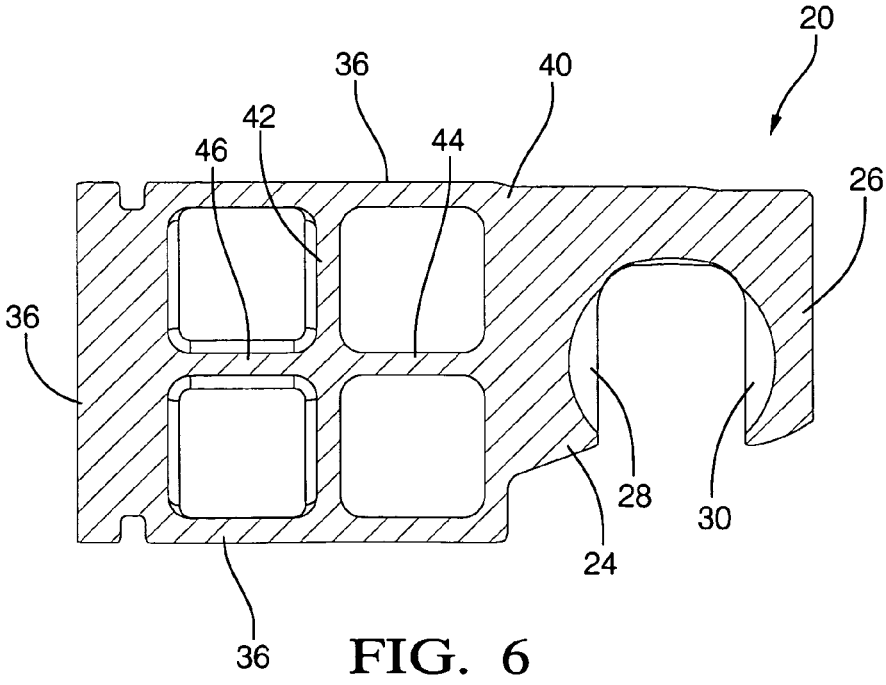
FIG. 6 is a cross section of a piston taken on the central plane P of FIG. 8.
Figure 7:
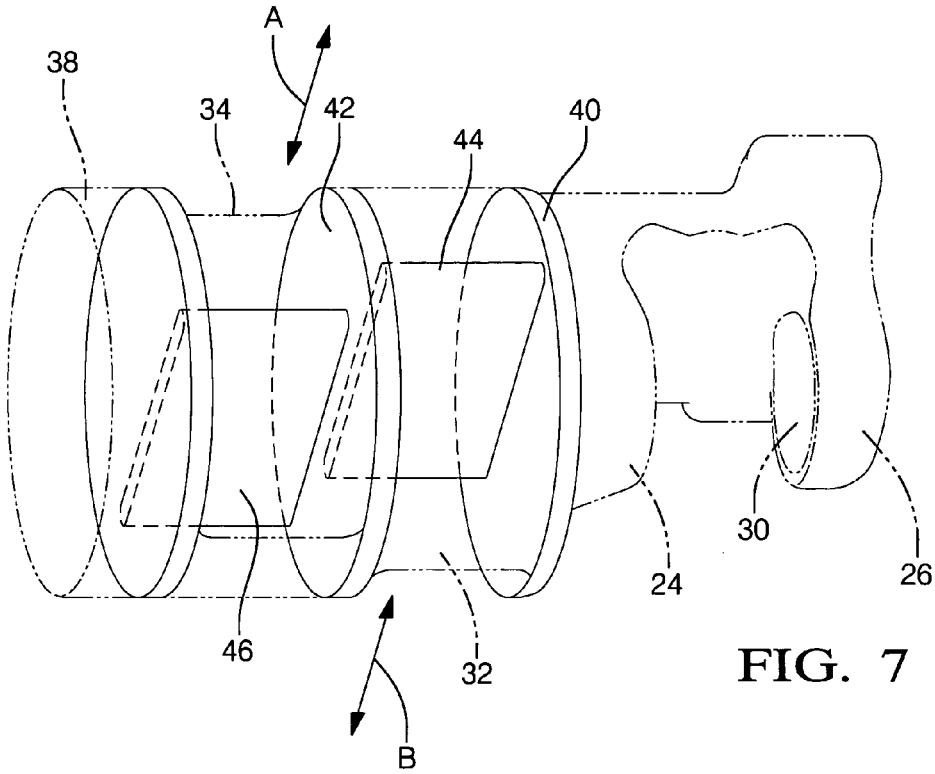
FIG. 7 is a schematic perspective view of a piston, showing outer surfaces in hidden lines and internal support structure in solid lines.

Still referring to FIGS. 3 through 7, the front and back ends of the two C shaped walls 34 and 32 are supported by a disk shaped head 38 and a disk shaped foot 40 respectively, structures which also provide the front compression surface of piston 20 and the structural connection to the stanchion 24. The outer surfaces of the head 38 and foot 40 comprise generally the surface portions F and B respectively. The walls 32 and 34 also receive robust internal support from a cruciform framework created by an intermediate or central support disk 42, and by a pair of axially extending webs 44 and 46, which are integral with the sides of central disk 42 with the foot 40 and head 38, and with the inside of each wall 32 and 34. All three elements of the internal support frame are perpendicular to the central plane P, and the webs 44 and 46 are also perpendicular to the central support disk 42. The details of the support frame are best seen in FIG. 7, and its cruciform nature is best seen in FIG. 5, which is a cross section along the central plane P. These structures are formed by the same single pair of dies or molds that form the walls 32 and 34. Specifically, referring to FIG. 7, one tool, moving in and out in the direction of the arrow A, would form the inner surface of arcuate wall 34, the web 46, one side of intermediate disk 42, and the outer surface of arcuate wall 32, as well as one half (180 degrees) of head 38, foot 40, and the stanchions 24 and 26. The other tool, moving in and out in the direction of arrow B, would form the inner surface of arcuate wall 32, the web 44, the other side of intermediate disk 42, and the outer surface of arcuate wall 34, as well as the other halves of head 38, foot 40, and the stanchions 24 and 26. This tool motion leaves behind the flattened, rather than concentrically arcuate inner surface, which thickens the narrow strips 36. These are sufficiently narrow, however, that there is no need to subsequently machine away the extra material. As noted above, the piston's central plane P can be arbitrarily located relative to the center axis of shaft 12, just in terms of describing how the forming tools move. However, it is a great advantage to have the central plane P bisect the stanchions 24 and 26, so that as much of the stanchions as possible can be integrally formed by the same tools. As shown, the webs 44 and 46 are central to the arcuate walls 32 and 34, creating essentially a symmetrical "E" when viewed axially, as best seen in FIG. 5. However, if the loads seen by piston 20 were, for some reason, more heavily concentrated toward the I or O quadrants, then either or both of the webs 44 and 46, could be shifted up or down, as viewed in FIG. 5, while still remaining perpendicular to the central plane P. This would represent no change to the basic design or manufacturing technique. In effect, the structure and the manufacturing technique are two sides of the same coin, each enabling the other. The internal support provided for the thin arcuate walls 32 and 34 is robust and well distributed, regardless of which direction the walls 32 and 34 are loaded. And the load support can be easily and flexibly redistributed by shifting the central disk 42 axially back and forth, or shifting the webs 44 and 46 up or down.

Changes to the disclosed embodiment could be made without departing from the basic structure or manufacturing method. If desired, just the front or body section of the piston 20, including the walls 32 and 34, and their internal supporting structures, could be over molded onto a separately and previously manufactured unit including the stanchions. As noted, the walls 32 and 34 could be molded so as to subtend only 180 degrees, up to, but not beyond, the central plane P. This would avoid the weight of the inevitably thickened, shared strips 36. As noted, the relative axial lengths of the two arcuate walls 32 and 34 could be adjusted relative to one another. Considering just the ease of manufacturing the piston 20 by itself, but assuming that the central plane P still bisects the stanchions 24 and 26, the location of the walls 32 and 34, and of the narrow strips 36, could be shifted 90 degrees. In that case, the webs 44 and 46 would extend parallel to, not perpendicular to, the central plane P, and instead of each tool symmetrically forming one half of each of the stanchions 24 and 26, one tool would form the outer surfaces of both, and one would form the inner surfaces of both. While the piston 20 would still be as easily manufacturable by itself, such a 90 degree shift would also shift the location of the piston outer bearing surface area sections 90 degrees relative to the corresponding sections of the inner surface of the bore 18. In general, then, the designer has a good deal of latitude in where to locate the piston outer surface bearing area, while maintaining the basic manufacturable shap of the piston.

What is claimed is:

1. An integral piston for use in a compressor having cylinder bores in which the piston outer surface makes close sliding contact with the cylinder bore, and in which the piston outer surface lies on a cylindrical outer envelope with a central axis A and is comprised of a front end F, a back end B, a semi cylindrical outer surface portion O, a semi cylindrical outer surface portion I diametrically opposed thereto, and a diametrically opposed pair of semi cylindrical surface portions S, said inner I and outer O surface portions being bisected by a central plane P through said central piston axis A, said piston comprising, a disk shaped head with an outer surface lying generally on F, a disk shaped foot lying generally on B, a intermediate support disk located axially between the head and foot formed generally perpendicular to the central plane P, a first generally C shaped, arcuate cross section side wall extending axially between the intermediate support disk and the foot and having an outer surface that extends circumferentially substantially to the central plane P, so as to lie on one outer surface portion S as well as one approximately half of the extent of the outer surface portions I and O, a second generally C shaped, arcuate cross section side wall extending axially between the intermediate support disk and the head and having an outer surface that extends circumferentially substantially to the central plane P, so as to lie on the other outer surface portion S as well as one approximately half of the extent of the outer surface portions I and O, a first generally planar support web internal to and integral with the first C shaped side wall, extending axially between the intermediate support disk and the foot perpendicular to the intermediate support disk, and, a second generally planar support web internal to and integral with the second C shaped side wall, extending axially between the intermediate support disk and the head perpendicular to the intermediate support disk.

2. An integral piston according to claim 1, in which in which the arcuate walls extend past the central plane sufficiently to form overlapping areas laying on the surface area portions I and O.

3. A integral piston according to claim 1, in which the support webs are also oriented perpendicular to the central plane P.

* * * * *